US007051385B2

(12) United States Patent
Gardner

(10) Patent No.: US 7,051,385 B2
(45) Date of Patent: May 30, 2006

(54) PORTABLE HANGING COT

(76) Inventor: Bryan J. Gardner, 314 18th St., Huntington Beach, CA (US) 92648

( * ) Notice: Subject to any disclaimer, the term of this patent is extended or adjusted under 35 U.S.C. 154(b) by 0 days.

(21) Appl. No.: 10/975,655

(22) Filed: Oct. 28, 2004

(65) Prior Publication Data

US 2005/0108821 A1 May 26, 2005

Related U.S. Application Data

(60) Provisional application No. 60/524,664, filed on Nov. 25, 2003.

(51) Int. Cl.
*A45F 3/22* (2006.01)

(52) U.S. Cl. ..... 5/122; 5/123; 5/127; 5/187

(58) Field of Classification Search ..... 5/120, 5/122, 123, 127, 98.3, 101–103, 187, 902
See application file for complete search history.

(56) References Cited

U.S. PATENT DOCUMENTS 1,150,008 A * 8/1915 Ampt ..... 5/627
4,375,110 A * 3/1983 Murphy ..... 5/98.3
5,170,520 A * 12/1992 Milliken ..... 5/98.3
5,511,258 A * 4/1996 Barr, Sr. ..... 5/104
5,673,444 A * 10/1997 Middendorf ..... 5/127
5,860,175 A 1/1999 Saiki
5,898,960 A 5/1999 Hill

* cited by examiner

*Primary Examiner*—Michael Trettel
(74) *Attorney, Agent, or Firm*—Fulwider Patton LLP

(57) ABSTRACT

A portable, suspendable cot used in rock climbing and the like includes a collapsible frame supporting a webbing therebetween. The frame includes linkages that pivot from a parallel orientation in a closed position to an orthogonal angle (for rectangular frames) or an acute angle (for trapezoidal frames) in an open position. The linkages further comprise couplings that complete the framework and use gravitational forces to enhance the linkages, forming a secure platform that resists warping. Cabling connects the respective linkages and supports the frame so as to be suspendable from a central apex vertically displaced from the frame. The cabling can pass through a free end of the pivoting links to guide the free end to the coupling, and preserve a closed loop for the respective elements of the frame.

16 Claims, 8 Drawing Sheets

PORTABLE HANGING COT

CROSS-REFERENCES TO RELATED APPLICATIONS

This application claims priority from U.S. Provisional Application No. 60/524,664, filed Nov. 25, 2003.

FIELD OF THE INVENTION

This invention relates generally to rock climbing equipment, and more specifically to a light-weight portable hanging cot used during climbing that is easier to assemble and disassemble, and provides a more secure resting platform than prior hanging cots.

BACKGROUND OF THE INVENTION

As the level of climbing and mountaineering has advanced, climbers have developed a need for better portable cots for sleeping and shelter during multi-day ascents of vertical cliffs and rock faces. A portable cot that can be stowed in a climber's equipment bag and assembled during mid-climb allows a climber to rest and obtain shelter from inclement weather as required. These versatile ledges can be used to weather a passing storm, provide a bed during the night of a multi-day climb, and may even be used as a base camp for expeditions that can last 30 days or more. Climbers rely on the hanging cots for relief and respite, and there is naturally a preference for hanging cots that are safe, lightweight, easily carried by the climber, and are quickly assembled and dismantled. Also, cots with many separated small components that can be lost or fall pose significant problems, so climbers would be better served if the cots have a limited number of separate elements to assembly. It is also preferable to have a cot that offers a maximum usable (living) surface area to weight ratio.

In alpine climates and other mountain areas, it is common for storms to arrive in with very little notice, a situation that can pose substantial risk to a climber. In this situation it is essential that a shelter with a cot adjoining a vertical rock face be assembled quickly. If the climber is alone or separated from a group—thus requiring individual assembly—the need for quick and easy assembly is even more imperative. Solo ascents of routes requiring a ledge have become a more regular occurrence. Further, for routes where a team of climbers live on a rock face for weeks at a time, it is important that they have a safe and comfortable base camp on the face of the rock to recover each night and to wait out storms that can sometimes last consecutive days. In all climbing events it is important for comfort and energy conservation that the ledge be as light weight as possible. The success of these expeditions is greatly affected by the energy and morale of the team, and these are greatly affected by how well they can recover each night.

A typical prior art portable ledge comprises a collapsible rectangular framework of connectable aluminum tubing with a cloth bed that attaches around the frame. The framework is suspended by a series of straps that are attached by one end to each corner and possibly the middle of the long sides of the rectangle. The other ends of these straps are sewn together at a central point above the ledge and approximately at the center. This central hanging point is secured to an anchor in the rock, forming a tent like structure hanging against the wall. These typically come with an optional "fly," a protective covering or tarp that extends from the anchor point over the ledge and straps to protect the climber from the weather.

These prior art ledges can be difficult to both assemble and dismantle. They consist of up to eight or more separate tubes and eight or more joints that each must be fitted together every time the ledge is to be assembled. The climber must locate appropriate complimentary components and construct the structure one piece at a time. If a connecting component should be dropped or lost, the results could be dire. Once the tubes are assembled into a framework, the bed must be secured and tensioned by the climber. This can be hazardous when a storm unexpectedly rolls in and a shelter must be quickly assembled. Likewise, dismantling the ledge can be as difficult as assembling it. Gravitational forces on the framework due to the weight of the cot can cause the tubes and joints to cam or rub together, making it difficult to retract the tubes from their fittings. Cold (or hot) weather can also exacerbate this problem and make disassembly awkward and difficult. This can delay the start of a day's climb and cause a frustrating situation before a day's climb has even begun.

Because of the constant push to reduce the weight of all gear carried, prior art ledges are sized to fit the average climber's shoulder width and sleeping length. Although this is usually acceptable during the period when a climber is sleeping, should it be necessary to put the protective covering (or "fly") down and wait out a storm, the prior art cots provide an uncomfortably confined living space—especially when used for multiple days in a row. These living conditions can sap a climber's enthusiasm and affect the success of the team on an expedition.

Another significant drawback to the prior art cots results from the system of joints. When the ledge is fully assembled it is possible for the tubes to rotate and/or slide within the joints, resulting in a departure from the preferred planar configuration. This condition may cause a slight warping of the cot (referred to as "potato chipping"). If this occurs while the climber is sleeping, the resulting discovery of this condition from a sound sleep at perilous heights can be quite unnerving. The safety of a ledge with this tendency is very questionable. The consequence is that many climbers have spent sleepless nights because their ledge had "potato chipped," and this condition has been known to have thrown a climber from his ledge.

Examples of prior art ledges include U.S. Pat. No. 5,860,175 to Saiki entitled Self Unfolding Portable Hanging Cot. Saiki teaches a rectangular cot using a system of pivots and hinges that unfolds into an operative position. Saiki's apparatus is excessively heavy and doesn't solve the problem of a confined living space. U.S. Pat. No. 5,898,960 to Hill, entitled Portable Ledge Apparatus And Method, discloses four support arms that fold into place from a central retainer member. These ledges fail to overcome the shortcomings of the prior art, and thus there remains a void in the prior art for a portable ledge that is lightweight, that can be easily assembled and dismantled by a single user, that offers sufficient space for living on the face of a cliff, and that is safe and reliable in all conditions.

SUMMARY OF THE INVENTION

It is the object of this invention to provide a portable hanging cot (ledge) that can be easily and quickly assembled and dismantled by a single user, that is lightweight compared to the prior art, and that offers greater functional living space and safety to the user.

Several advantages of this invention over prior art are:

a) Providing a system of framework joints that include both fixed pivoting joints, combined with respective mating joints that allows fast and easy assembly and dismantling.
b) Providing mating joints that require minimal contact with the overlapping tubular members to prevent jamming during assembly and dismantling, and are still functional if slightly bent or disfigured.
c) Providing a safer cot that resists "potato chipping."
d) Providing a cot that is lighter than prior art cots, and capable of carrying greater weights.
e) Providing a bed surface that is automatically tensioned by the assembled frame.
f) Providing superior functional living space to the user over existing hanging cots.

These advantages are primarily offered by a unique method of joining the tubular members that comprise the framework of the hanging cot. One tube is fixed to the adjoining tube by a joint that allows the tubes to pivot from a substantially parallel orientation to a predetermined angular orientation, for example a perpendicular orientation. The opposite side of the tube is guided to a mating joint on a cooperating tube along a suspension cable connected at the respective corner. The mating joint permits engagement of the end tube with a short translation, and holds the end tube in such a manner that the weight of the user preferably reinforces the engagement of the tube in the joint. Further, the mating of the tubes accommodates without impacting the suspension cable, which continues to serve its dual purpose of guiding the end tube into the joint while supporting for the hanging cot.

This joint method can be applied to a frame of trapezoidal shape wherein the foot end is a shorter end tube, and is connected to both sides by two pivoting joints or a pivoting joint and a mating joint. This trapezoidal configuration offers the climber greater functional living space by increasing the width around the shoulders, and reducing the width near the climber's feet where space is less critical. The suspension cords of the hanging cot can also be removed from their central collection point in order to be secured individually from underneath an overhead ledge in a parallel configuration to provide greater overhead space. This offers additional living space to the climber unmatched by any prior art hanging cot. The hinged and mated tubes in their respective positions of the ledge can be fixed using pins or a tabs/slot arrangement such that the tubes cannot rotate within each other in a manner that causes the ledge to "potato chip."

DETAILED DESCRIPTION OF THE INVENTION

Figure 1:
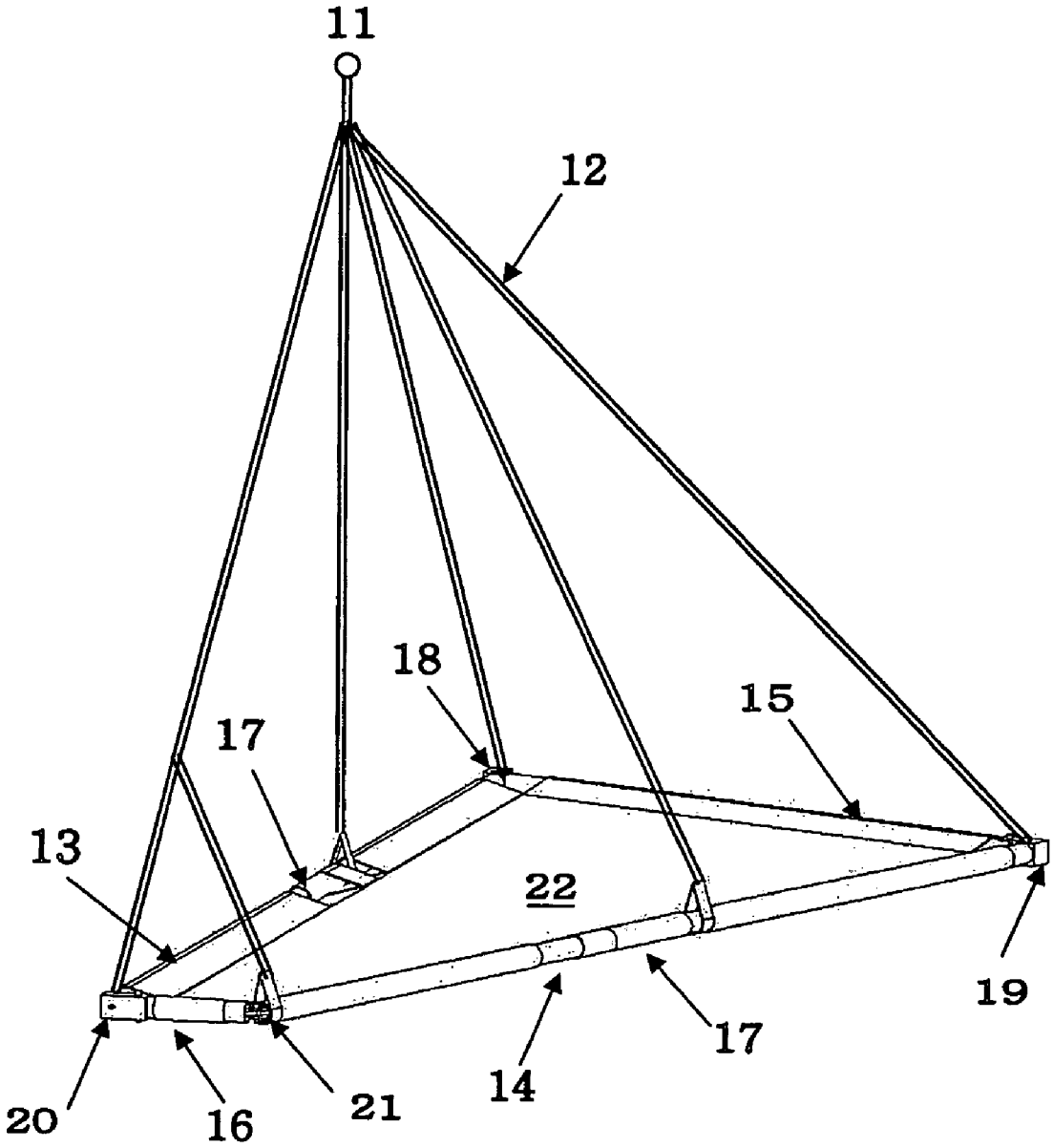
FIG. 1 is an elevated perspective view of a first embodiment of the present invention.

A first preferred embodiment of the present invention is shown generally in FIG. 1 comprising a trapezoidal framework formed by a collapsible set of linking tubular members, with cabling for suspending the framework from an elevated central apex such as a hook. A bed surface formed of strong yet flexible woven material or suitable high strength/low weight cloth connects to the collapsible frame using stitched loops that receive the tubular members to form the living space of the cot. The bed surface can be secured to the frame in a preferred embodiment such that the combination is stored together and the bed surface is not separated while being carried, so that when the frame is assembled the bed surface is already in place for the climber to use. Because the bed surface is sized for the expanded framework, there is no need to perform tightening of the bed surface after the cot is unfolded—a major timesaver not found in prior art systems. The frame is formed with a combination of hinged (i.e., pivoting) linkages that collapse into a linear configuration for ease of storage, and mating connections for transverse couplings that secure the tubular members into a rigid structure. Each frame link is preferably formed of a tubular member of aircraft grade aluminum or a composite material sufficient to withstand the tensile and bending stresses formed by the use of the bed. With the bed surface secured to the frame and the frame hung from a suspension hook, or suitable alterative via the cabling, the climber can enjoy a rest on a rock face or mountain ledge that provides shelter from the elements.

The frame of FIG. 1 includes a first longitudinal tubular member that is designated as the wall member 13 for reference only because it is preferably the side of the frame that extends adjacent the vertical face of the mountain or rock from which it is suspended. On the opposite side is a second longitudinal member designated as the free (or "sky") member 14. Connecting the wall member 13 and free member 14 at opposite ends are transverse tubular members designated as the head member 15 and the foot member 16. The trapezoidal frame of the embodiment of FIG. 1 is established by the four connected tubular members 13, 14, 15, 16, tautly supporting the bed material 22 thereon. The wall member 13 and the free member 14 may each preferably be comprised of two interlocking tubular sections that are connected together at interlocking joint 17. These interlocking segments can readily be decoupled for storage to greatly reduce the dimensions of the hanging cot in the packed away condition. Alternatively, the wall member 13 and free member 14 can fold using an intermediary hinge joint to reduce the storage requirement of the two longitudinal members without the need for separate components.

Figure 9:
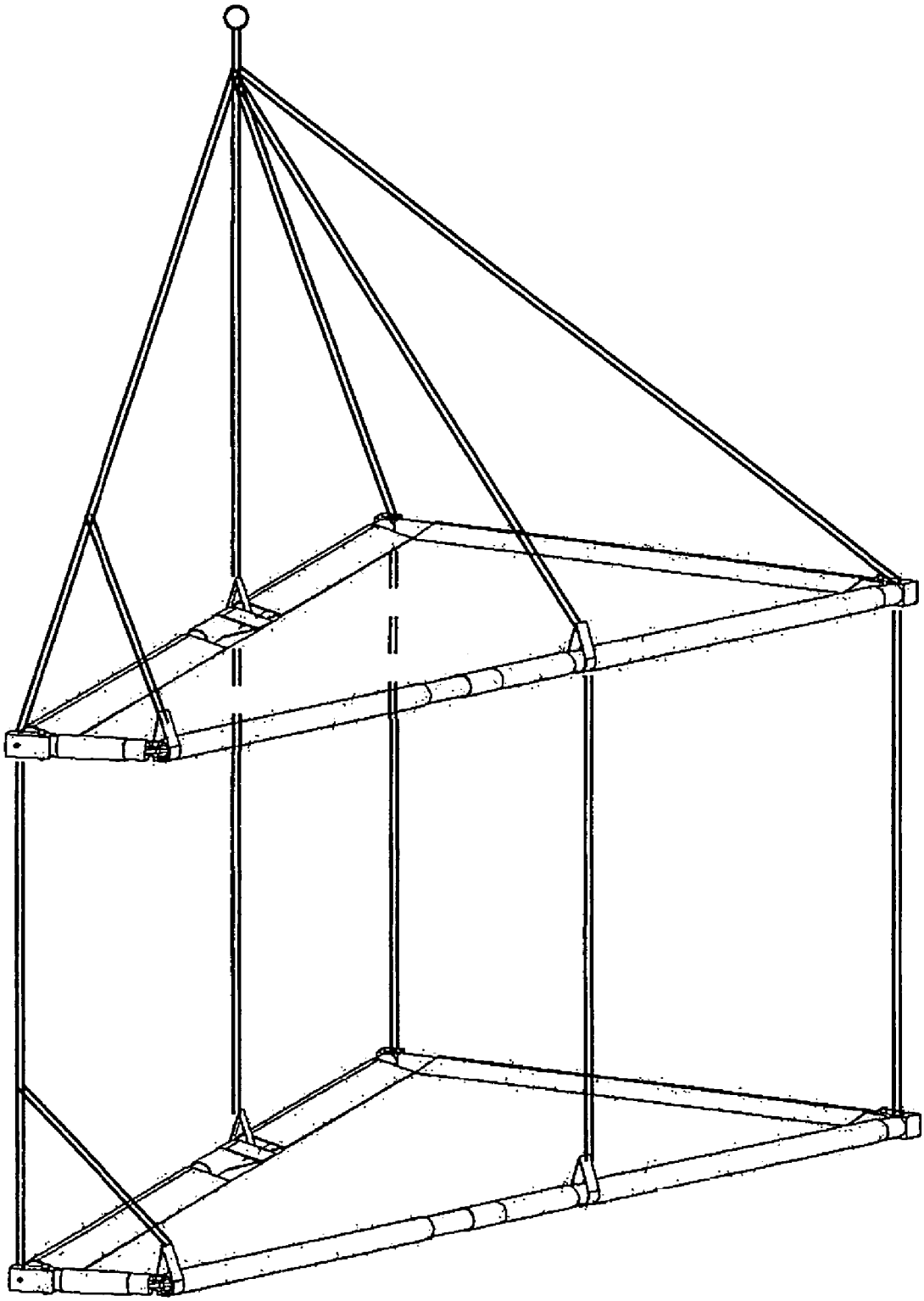
FIG. 9 is an elevated perspective view of a third embodiment of the present invention.

The frame is shown supported by six cables 12 that connect to the tubular members at each corner as well as approximate midpoints of the wall member 13 and the free member 14. Each cable 12 extends vertically from the respective frame connection to a suspension hook 11. One significant advantage of a preferred embodiment of the present invention is the use of round cords instead of flat ribbon for suspending the cot. A ratchet cam suitable for tensioning the round cable allows a stronger, lighter, easier-to-adjust cabling system over the use of flat ribbon. Moreover, the use of round cords facilitates the vertical stacking of multiple cots as shown in FIG. 9 by making the arrangement less cumbersome, significantly augmenting the volume of space for the climber due to the columnar, rather than tetrahedral, alignment of the cabling.

In a first preferred embodiment, the foot member 16 and the head member 15 are connected to the free member 14 at pivoting joints 21, 19 respectively. The range of motion of the joints extends from parallel, i.e. "closed" to the angles required to form the trapezoid as shown in FIG. 1. Because the pivoting joints automatically open to the correct angular orientation at the extreme open position, the climber need only fully extend the pivoting joints 21, 19 to establish the correct geometric configuration of the hanging cot, and then secure the remaining loose ends of the head member and foot member at joints 18, 20 to complete the formation of the framework.

Figure 2:
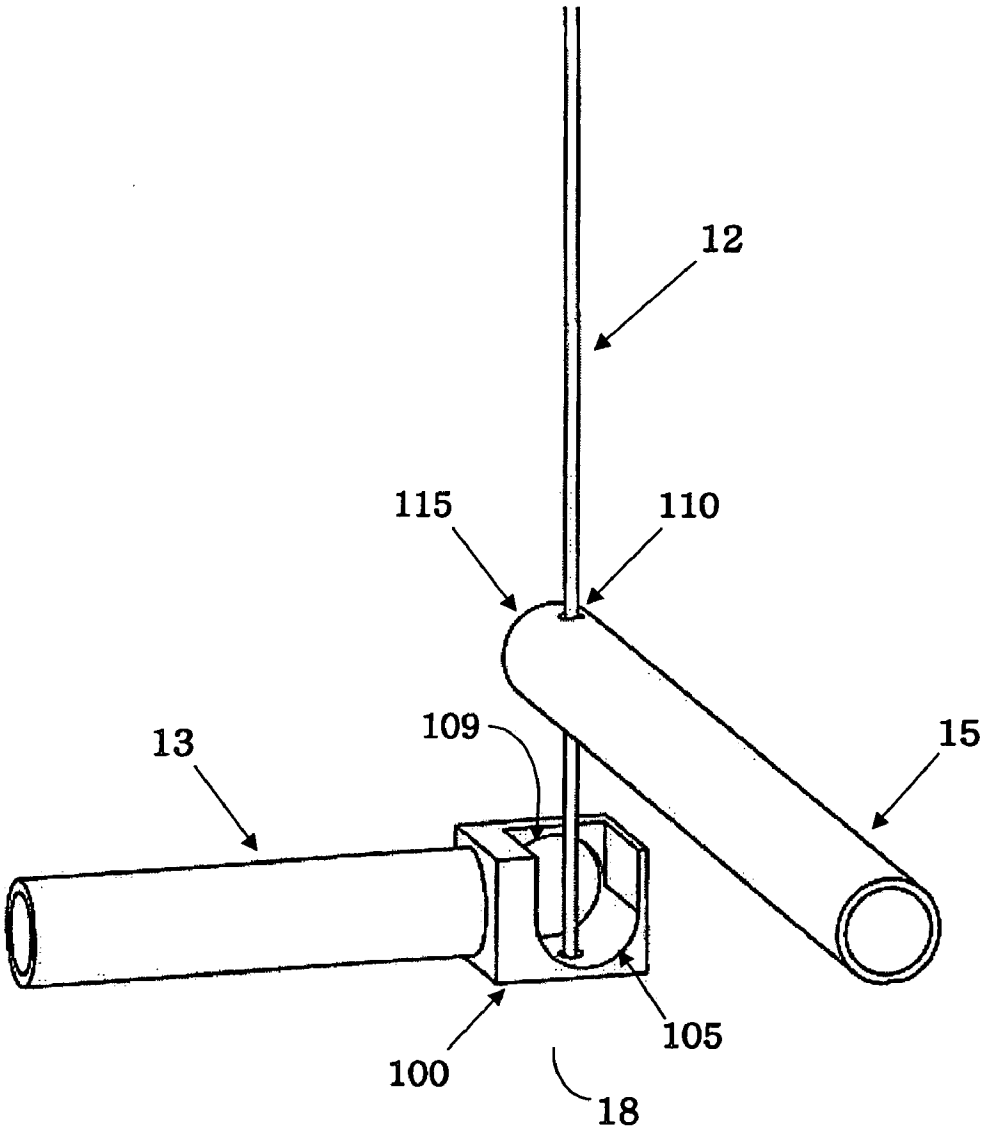
FIG. 2 is an enlarged, perspective view of a first embodiment of a mating joint of the present invention.

Joints 18, 20 connect the head member 15 and foot member 16 to the wall member 13, respectively. A unique feature of these joints is shown in FIG. 2. Wall member 13 includes at each end a coupling 100 including a U-shaped recess 105 opening vertically as shown. The U-shaped recess is sized to receive the proximal end 115 of head member 15 therein. The suspension cable 12 is secured to the coupling 100 at the base of the U-shaped recess, and is further threaded through a pair of eyelets 110 in the end 115 of head member 15 such that the end 115 can freely move along the cable 12. With the pivoting joint 19 fully extended, the end 115 of the head member 15 is guided by the cable 12 into the U-shaped recess 105 and secured therein. When end 115 is engaged in recess 105, the head member 15 can slide axially into a fitted aperture 109 of coupling 100 to more fully secure the joint. Further, the downward force of the head member 15 due to its weight and the weight of the climber forces the proximal end against the base of the U-shaped recess and this serves to reinforce the joint. Risk of accidental uncoupling of the mating joint 18 is reduced, as an upwardly directed force on the head member 15 sufficient to overcome the gravitational forces is required to dislodge the head member proximal end 115 from the coupling 100 once in place. This effect is more dramatic when the climber is on the bed surface, as the climber's weight is added to the joint to further secure it.

As can be seen in FIG. 2, as the head member 15 moves into the coupling 100, the cable 12 passes through the head member 15 and connects directly to the wall member 13, so the downward force of the head member 15 bears against the upward force of the wall and free members due to the tension from the cabling, forcing the mating joints 18, 20 together. Thus, the mating joints 18, 20 of the hanging cot are fortified as greater weight is applied to the bed surface due to the mating joint design and the connection of the cable to the wall and free members 13, 14, but passing through (without supporting) the head and foot members 15, 16.

Figure 3:
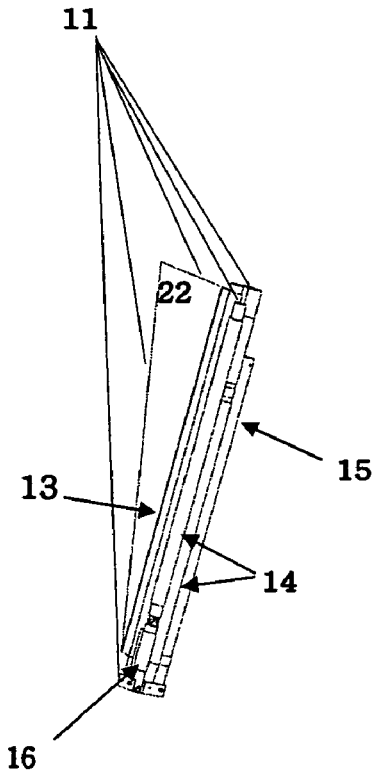
FIG. 3 is an elevated perspective view of the first embodiment of FIG. 1 in a disassembled, compact configuration.
Figure 4:
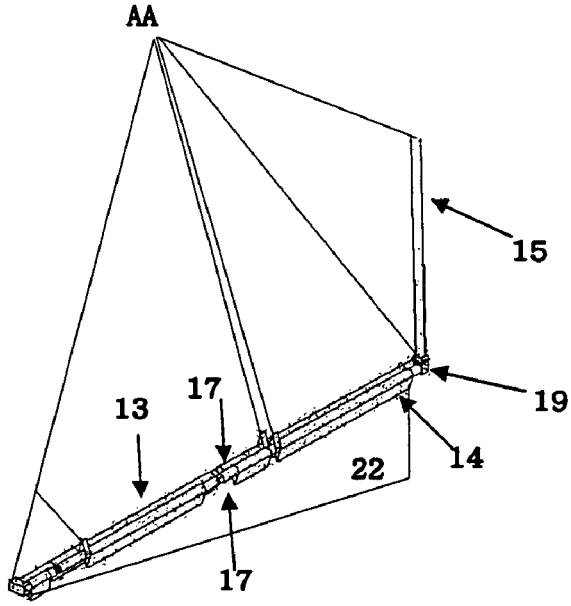
FIG. 4 is an elevated perspective view of the first embodiment of FIG. 1 in a partially assembled, slightly opened configuration.

FIGS. 3–6 illustrate the assembly steps of the hanging cot as would be constructed on a rock face during a climb. FIG. 3 is a perspective view of the collapsed configuration with the cables 12 extended and the tubular members decoupled and aligned parallel for minimizing storage space. In FIG. 3, head member 15 and foot member 16 are pivoted at their respective pivot joints to a parallel alignment with wall and free members 13, 14. Each cable 12 is secured to a suspension hook (not shown) at apex 11 above the hanging cot from which the frame can safely hang. With the cables 12 supporting the frame such that the tubular members are horizontally disposed, head member 15 is pivoted away from free member 14 to a substantially vertical position (for the trapezoidal framework the included angle is acute) as shown in FIG. 4. Respective segments of wall member 13 and free member 14 are inserted together at connection 17, and an option is to pin together the respective segments to prevent respective rotation of the adjoining halves that could lead to potato chipping.

Figure 5:
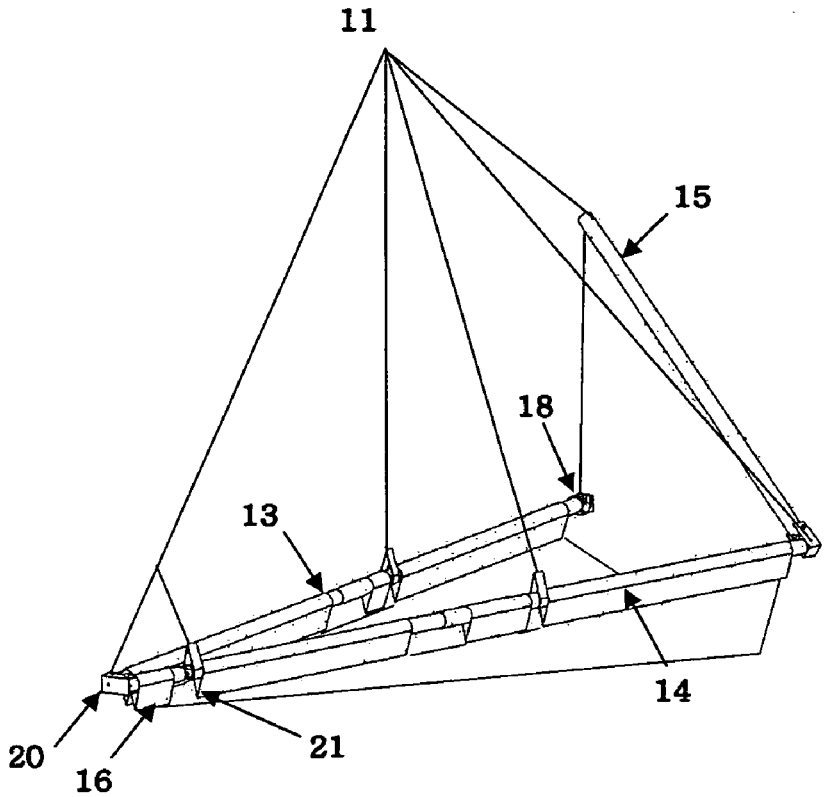
FIG. 5 is an elevated perspective view of the first embodiment of FIG. 1 in a substantially assembled, substantially opened configuration.
Figure 6:
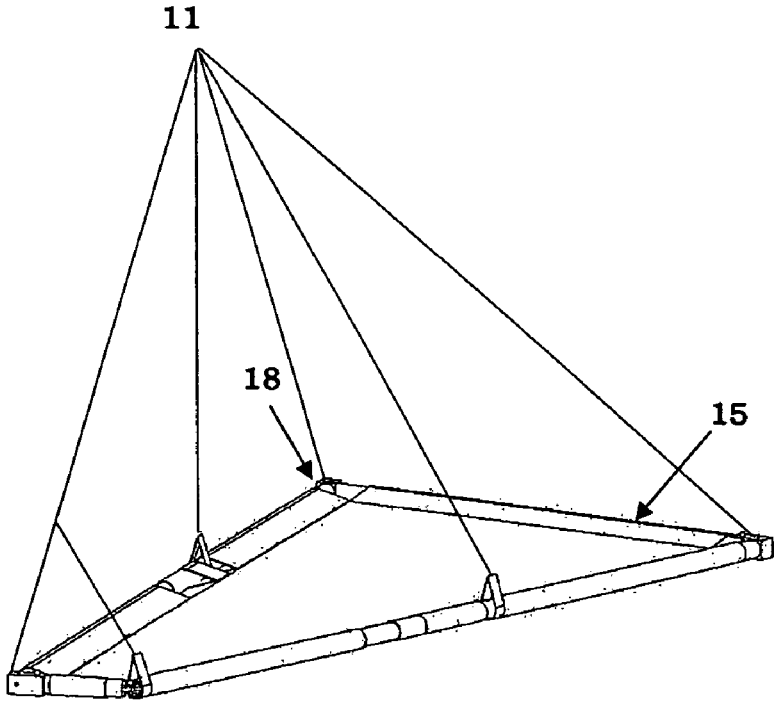
FIG. 6 is an elevated perspective view of the first embodiment of FIG. 1 in the fully assembled, open configuration.

At FIG. 5, wall member 13 and free member 14 are pivoted apart, causing the pivoting joint 21 at foot member 16 to open to the designated obtuse interior angle between the foot member 16 and the free end 14. As the ends of the wall member 13 and free member 14 adjacent the head member 15 separate, the vertically aligned head member 15 is guided along its respective suspension cable into a horizontal position (step 6). The head member 15 is then locked into the respective mating coupling 100 at the end of wall member 13 to complete the assembly of the frame and hanging cot structure (FIG. 6). Similarly, the foot member 16 engages and locks into wall member 13 at the opposite end (joint 20). Alternatively, the foot member 16 can be connected to both the wall member 13 and the free member 14 by pivoting joints that cooperate to form the necessary geometry at the base or foot area of the cot. The resulting trapezoidal frame formed by the union of the wall member 13 to the head member and foot member at joints 18 and 20, respectively, provides a secure and stable platform from which the climber can enjoy comfort and rest.

Figure 7:
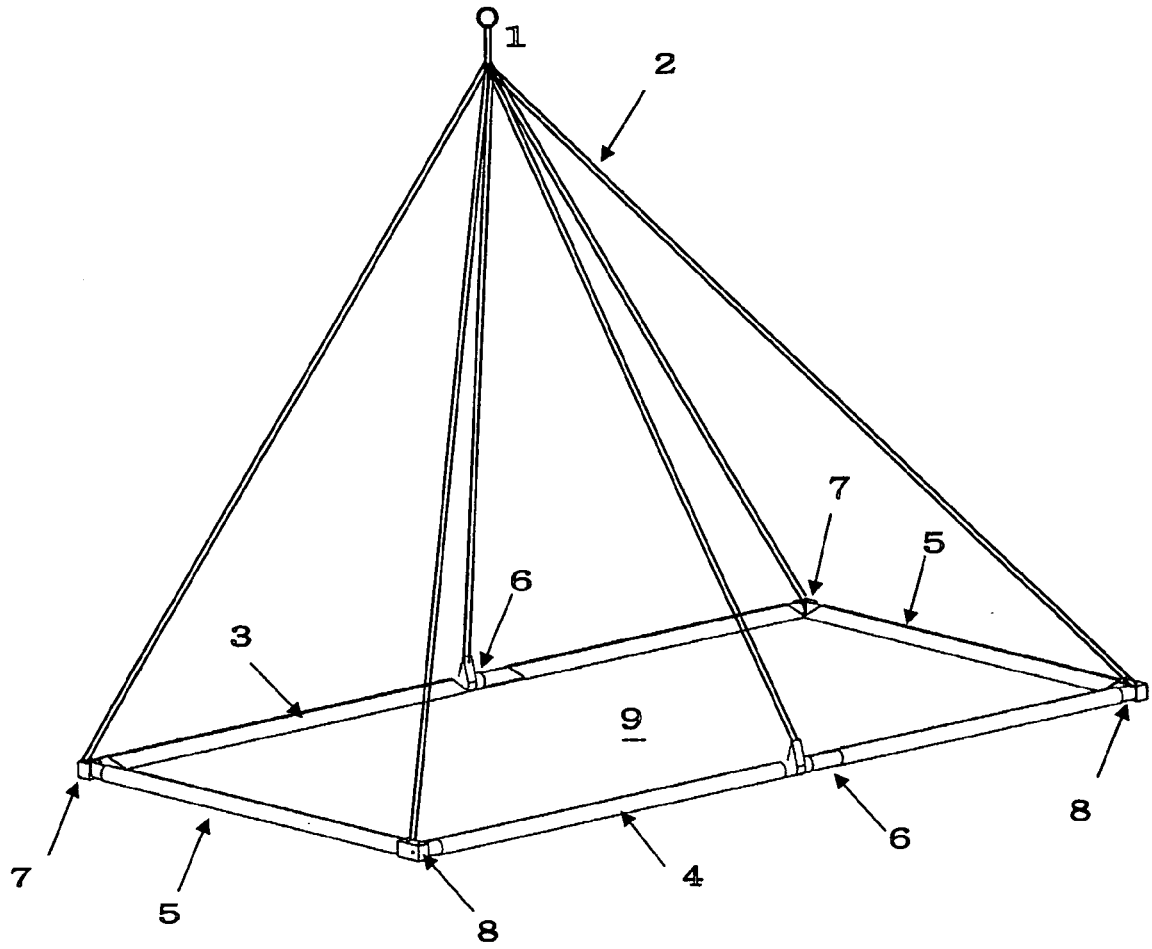
FIG. 7 is an elevated perspective view of a second embodiment of the present invention.
Figure 8:
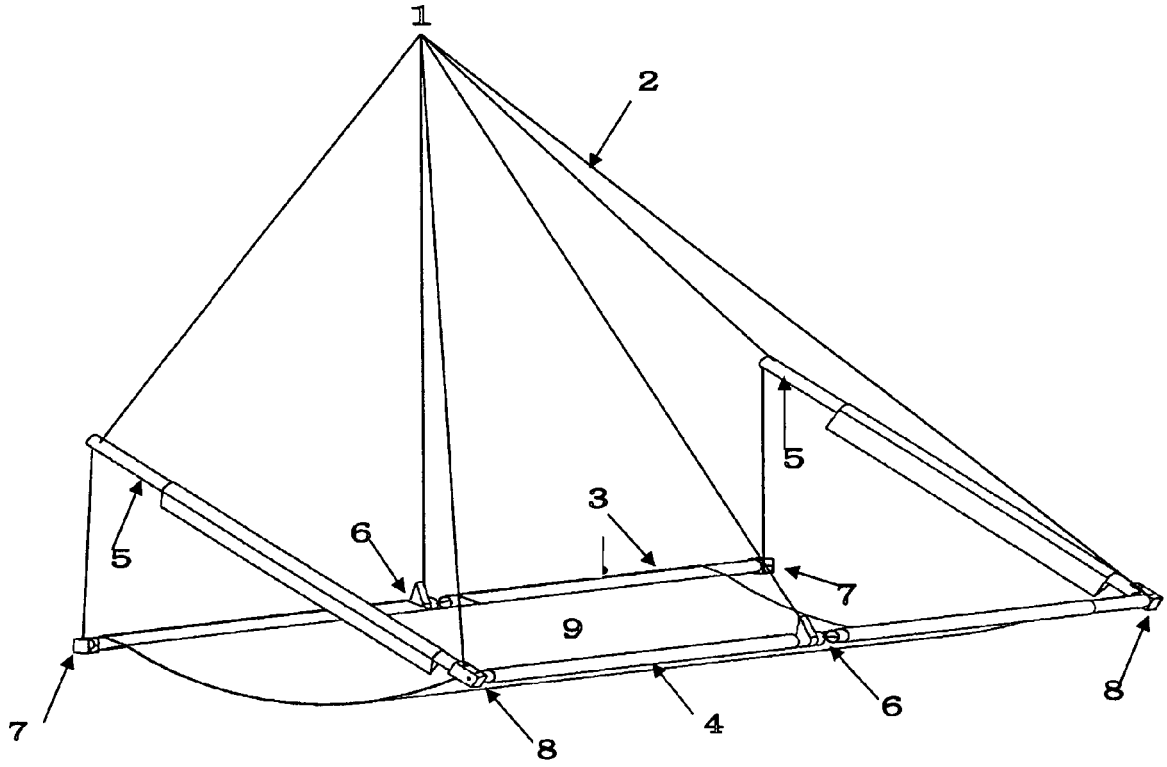
FIG. 8 is an elevated perspective view of the second embodiment of FIG. 7 in a partially assembled configuration.
Figure 10:
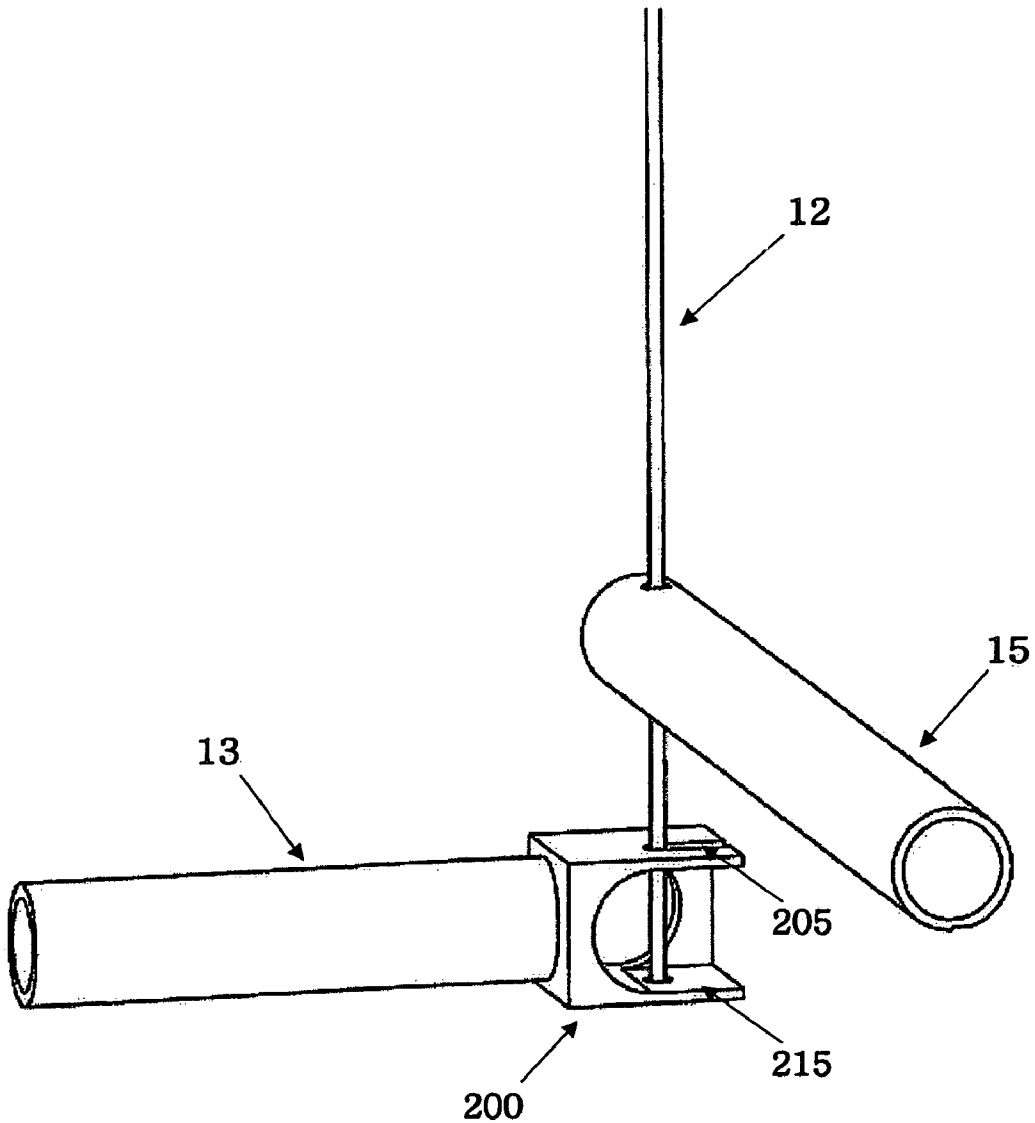
FIG. 10 is an enlarged, perspective view of a second embodiment of the mating joint of the present invention.

FIGS. 7 and 8 illustrate an alternate embodiment of a rectangular construction to the trapezoidal frame of FIG. 1. In FIG. 7, the wall member 3 and free member 4 are similar to the embodiment of FIG. 1. Pivoting joints 8 rotate ninety degrees from a parallel orientation to an orthogonal orientation to create the rectangular frame shown. The wall member 3 and free member 4 are formed by respective halves joined together at juncture 6, and mating joints 7 are similar to the joints 18, 20 of the trapezoidal configuration. It should be noted that the position of the pivoting joints and the mating joints can be rearranged without departing from the spirit of the present invention, and the number of each could be altered so that there are more pivoting joints than mating joints, or vice versa. In FIG. 8, the bed surface 9 extends between the wall member 3 and the free member 4, and the head and foot members 5 are interchangeable. Cables 2 similarly extend from each corner as well as midpoints of wall and free members 3, 4. As with the trapezoidal configuration, the cables are supported by the longitudinal sides, and less so by the transverse tubular members 5 because the cables pass through eyelets of the transverse members at the mating joints 7. FIG. 10 illustrates an alternate embodiment of the mating joint of FIG. 2 wherein the U-shaped recess 215 is oriented in the horizontal, rather than vertical, direction. The coupling 200 includes a slot 205 that accommodates the cable 12, and the transverse member 15 is positioned horizontally in the recess. The tension of the cable 12 prevents the transverse member 15 from sliding out of the recess once the weight of the cot (and the climber) is supported by the longitudinal member 13. In both the joints of FIGS. 2 and 10, gravitational forces (and the fitted aperture 109 of the coupling) tend to keep the joint secure and prevent accidental dislodging of the transverse member from the coupling.

The above described embodiments are designed to be illustrative only, and are not intended to limit the scope of the invention in any way. Those of ordinary skill in the art will appreciate that there are various modifications and variances from the described embodiments without departing from the spirit of the invention. Accordingly, the scope of the inventions described herein are to be measured solely by the words of the claims appended hereto.

I claim:

1. A collapsible hanging cot comprising:

first and second spaced apart longitudinal members supporting a flexible webbing therebetween;

a first transverse linking member having first and second ends, said first end fixed and pivotally connected to said first longitudinal member, and said second end connectable to said second longitudinal member at a releasable coupling, wherein said releasable coupling comprises an open ended recess disposed on one of said second longitudinal member and said second end of said first transverse linking member, said recess sized to receive the other of said second end of said first linking transverse member and said second longitudinal member therein; and cabling for vertically suspending said collapsible cot, said cabling passing through said second end of said first transverse linking member and connected to said second longitudinal member.

2. The collapsible hanging cot of claim 1 further comprising a second transverse linking member having first and second ends, said first end fixed and pivotally connected to one of said first and second longitudinal members, and said second end connectable to a different one of said first and second longitudinal members at a releasable coupling, wherein cabling passes through said second end of the second transverse member and is connected to said different one of said first and second longitudinal members.

3. The collapsible hanging cot of claim 2 wherein said first and second longitudinal members cooperate with said first and second transverse members to form a trapezoid.

4. The collapsible hanging cot of claim 2 wherein said first and second longitudinal members cooperate with said first and second transverse members to form a rectangle.

5. The hanging cot of claim 1 wherein said releasable coupling comprises a U shaped recess that opens vertically such that said other of said second end of said first transverse member and said second longitudinal member enters said U shaped recess from above.

6. The hanging cot of claim 1 wherein said releasable coupling comprises a U shaped recess that opens horizontally such that said other of said second end of said first transverse member and said second longitudinal member enters said U shaped recess laterally.

7. The hanging cot of claim 1 further comprising an aperture in said coupling matching a cross-section of said other of said second end of said first transverse member and said second longitudinal member and receiving said one of said second longitudinal member and said second end of said first transverse linking member therein.

8. The hanging cot of claim 1 wherein said first and second longitudinal members are each comprised of interlocking tubular segments that decouple for storage, and connect so as to preclude relative rotation therebetween.

9. The hanging cot of claim 8 further comprising a pin passing through said interlocking tubular segments for preventing relative rotation therebetween.

10. The hanging cot of claim 1 wherein said cabling comprises separate cables connecting respective corners to a vertically displaced apex.

11. The hanging cot of claim 1 wherein the cabling comprises a circular cross section.

12. The hanging cot of claim 1 wherein said longitudinal members and transverse members collapse into a parallel arrangement.

13. The hanging cot of claim 1 comprising a second transverse linking member having first and second ends fixed and pivotally connected to said first and second longitudinal members.

14. The collapsible hanging cot of claim 13 wherein said first and second longitudinal members cooperate with said first and second transverse members to form a trapezoid.

15. The collapsible hanging cot of claim 14 wherein said first and second longitudinal members cooperate with said first and second transverse members to form a rectangle.

16. The collapsible hanging cot of claim 1 wherein said first and second longitudinal members include an intermediary hinge member that allows the longitudinal members to fold in half.

* * * * *